US006659323B2

(12) United States Patent
Vaidyanathan et al.

(10) Patent No.: US 6,659,323 B2
(45) Date of Patent: Dec. 9, 2003

(54) METHODS AND APPARATUS FOR PRESCRIBING WEB TRACKING IN PROCESSING EQUIPMENT

(75) Inventors: Nandakumar Vaidyanathan, Litchfield, NH (US); Robert Bruce Lowd, Chestnut Hill, MA (US)

(73) Assignee: Presstek, Inc., Hudson, NH (US)

( * ) Notice: Subject to any disclaimer, the term of this patent is extended or adjusted under 35 U.S.C. 154(b) by 29 days.

(21) Appl. No.: 10/060,484

(22) Filed: Jan. 30, 2002

(65) Prior Publication Data

US 2003/0141339 A1 Jul. 31, 2003

(51) Int. Cl.[7] ..... B65H 20/00; F26B 13/10; F26B 21/06

(52) U.S. Cl. ..... 226/97.3; 34/530; 34/559

(58) Field of Search ..... 226/95, 97.3; 34/361, 34/525, 530, 558, 559

(56) References Cited

U.S. PATENT DOCUMENTS 3,075,679 A * 1/1963 Wadey ..... 226/95
4,065,044 A * 12/1977 Painter et al. ..... 226/95
4,761,256 A * 8/1988 Hardenbrook et al. ..... 264/45.5
4,943,446 A * 7/1990 Isherwood et al. ..... 427/9
5,232,141 A * 8/1993 Mittmeyer et al. ..... 226/95
5,667,418 A * 9/1997 Fahlen et al. ..... 445/25
5,950,899 A * 9/1999 Bassa ..... 226/97.3
6,443,389 B1 * 9/2002 Palone ..... 226/97.3

OTHER PUBLICATIONS

Jones, D.P., "Traction in Web Handling: A Review" Proceedings of the 6th International Conference on Web Handling, Jun. 10~13, 2001, Emral Ltd. UK, 23 pgs.
Schwarz, W., "Thermo–Mechanical Behaviour of the Web during Coating," Leybold AG, Hanau, 13 pgs.
Wales et al., "Model For Thermal Creasing In Roll–To–Roll Vacuum Metallising," Proceedings of the 2nd International Conference on Web Coating, Bakish Materials Corp., B.V.T. Ltd., Sep. 9~11, 1988, pp. 204–215.

* cited by examiner

*Primary Examiner*—Michael R. Mansen
(74) *Attorney, Agent, or Firm*—Testa, Hurwitz & Thibeault, LLP

(57) ABSTRACT

Methods and apparatus to reduce or eliminate misalignment, wrinkles, and creases in coated web product. A relationship between web outgassing pressure and surface roughness of the web and web transporting rollers is developed. This relationship allows for the control over the web outgassing pressure. The ability to adjust the web tension pressure, as well as the selection of web transporting rollers with prescribed surface characteristics, allows an operator to control the degree to which the web floats over or tracks the web transporting roller. A controller, in response to pressure and tension sensors, can also provide dynamic, closed-loop control of the entire system.

20 Claims, 6 Drawing Sheets

METHODS AND APPARATUS FOR PRESCRIBING WEB TRACKING IN PROCESSING EQUIPMENT

FIELD OF THE INVENTION

The present invention relates generally to web processing equipment and, more specifically, to methods and apparatus for steering the web as it travels through the processing equipment.

BACKGROUND OF THE INVENTION

Web coating refers to the process of depositing one or more materials onto a thin heat-sensitive substrate, supplied in the form of a continuous, large-quantity roll (i.e., a "web"). The web is unwound and passed through one or more stations in processing equipment, each of which deposits a material onto the web, generally under vacuum. After the web passes through all of the stations, it is rewound onto another roll and readied for further processing or shipment. One product typically manufactured by such a process is magnetic recording tape, where a polyester film is coated with ferromagnetic material.

Processing equipment used for web coating generally includes a series of web transport rollers. These rollers unwind, tension, steer, and wind the web as it travels through the processing equipment. Frictional forces at the interface between the web and a roller provide traction that causes the web to move through the equipment in the direction that the rollers establish.

FIG. 1 depicts a simplified schematic representation of an example of web processing equipment 100. Processing equipment 100 includes a source 102 of web material 104 in roll form. A pumping system 116 with a pumping port 118 helps maintain the proper pressure (e.g., vacuum) in the processing equipment 100. Also included are three material deposition stations 106, 108, 110, each of which can deposit a different material onto the web 104. As the web 104 exits the last material deposition station 110, it is rewound onto a take-up roll 112.

Generally included in each material deposition station 106, 108, 110 is a web transporting roller 114 and a steering section 200. Material is deposited on the web 104 as the web 104 travels about the web transporting roller 114. FIG. 2 shows the steering section 200 in detail. In the present example, the steering section 200 includes an entering roller 202 that receives the leading edge of the web 104. The web 104 is then received by a first guide roller 204 and a second guide roller 206. The guide rollers 204, 206 are parallel to each other. The web 104 then passes to an exit roller 208 en route to the web transporting roller 114 and then on to another material deposition station or the take-up roll 112.

One common problem with the aforementioned processing equipment 100 is a misalignment 210 between the entering roller 202 relative to the guide rollers 204, 206. An additional misalignment 212 between the exiting roller 208 and the guide rollers 204, 206 can also happen. When one or both of these conditions occur, the steering section 200 often cannot restore the proper alignment. A result of this condition is that wrinkles, or creases, or both, form in the web 104 as it travels through the processing equipment 100. The wrinkles or creases tend to accelerate degradation of the coated web product. Further, the wrinkles or creases can hamper the efficient operation of the processing equipment 100, causing downtime as an equipment operator must, for example, manually realign the web 104.

From the foregoing, it will be apparent that there is still a need for a way to control the travel of the web 104 through the processing equipment 100 in order to minimize or eliminate wrinkles, or creases, or both, with minimal or no operator intervention.

SUMMARY OF THE INVENTION

The present invention affords control over the degree to which a web floats over (i.e., avoids contact with) or tracks (i.e., contacts) a web transporting roller in processing equipment, such as coating machinery, typically when under vacuum. Adjusting the web tension, or web transporting roller configuration, or both, facilitates this control. A result is that web wrinkling or creasing induced by, for example, steering or other rollers, is reduced or eliminated. This leads to improved performance and decreased downtime of the processing equipment, and minimizes degradation of the web product.

In one embodiment, the invention provides a method for prescribing the operational web tension pressure in relation to the web outgassing pressure. Briefly, outgassing is the evolution of gas embedded in a liquid or solid. The gas is typically released when the liquid or solid is heated, or the surrounding pressure is reduced, or both. In one embodiment discussed herein, the web is placed under vacuum in the processing equipment, which causes the release of gas embedded in the web. By adjusting the web tension pressure so it is less than the web outgassing pressure, the web is caused to float over the web transporting roller. Conversely, setting the operational web tension pressure so it exceeds the web outgassing pressure will cause the web to track the web transporting roller. The choice of causing the web to float or track depends on, for example, the type of web material used and the nature of the processing performed.

One way of setting the operational web tension pressure is to compute the molecular density of the substance (typically water vapor) outgassing from the web. From this density value one can compute a target web tension pressure and set the operational web tension pressure accordingly.

The operational web tension pressure can also be controlled dynamically. During operation, a system according to the invention monitors the web outgassing pressure. The system then adjusts the operational web tension pressure to maintain the desired relationship between it and the web outgassing pressure. The adjustment can be performed in real time, automatically, and without operator intervention, typically using a closed-loop control system.

In another embodiment, the invention provides a method for prescribing the degree to which a web floats or tracks as it passes over one or more web transporting rollers by selecting a particular configuration of rollers for use in the processing equipment. The configuration is based in part on the average surface roughness of each web transporting roller. The average surface roughness required to achieve a desired degree of floating or tracking may be based at least in part on a computed molecular density of the substance outgassing from the web and a desired operational web tension pressure. Web transporting rollers having the appropriate average surface roughness corresponding to the molecular density and the desired operational web tension pressure are then selected for use in the equipment.

One version of the invention includes apparatus for adjusting the operational web tension pressure. In this version, sensors monitor the ambient pressure due to outgassing about the web transporting roller and the tension pressure of the web. A tensioning roller responds to the ambient pressure and adjusts the web tension pressure to maintain the desired relationship between the pressure values. A variation of this version includes a controller that accepts data from the pressure sensors and operates an actuator that, in turn, adjusts the tensioning roller accordingly. A further variation includes the logic necessary to compute molecular density and target web tension pressure and adjust the tensioning roller in relation to the latter.

Another embodiment of the invention provides an article of manufacture that includes a program storage medium having computer-readable program code for prescribing the degree to which a web floats about a web transporting roller. The code includes portions for monitoring web outgassing pressure during web transporting roller operation, and adjusting operational web tension pressure in relation to the monitored pressure. Additional code causes a computer to compute a web outgassing molecular density and target web tension pressure, and set the operational web tension pressure in relation to the latter. In another embodiment, a program storage medium tangibly embodies a program of instructions executable by a computer to perform the method steps for prescribing the degree to which a web floats about a web transporting roller.

Other aspects and advantages of the present invention will become apparent from the following detailed description, taken in conjunction with the accompanying drawings, illustrating the principles of the invention by way of example only.

BRIEF DESCRIPTION OF THE DRAWINGS

The foregoing and other objects, features, and advantages of the present invention, as well as the invention itself, will be more fully understood from the following description of various embodiments, when read together with the accompanying drawings, in which.

DETAILED DESCRIPTION

Figure 1:
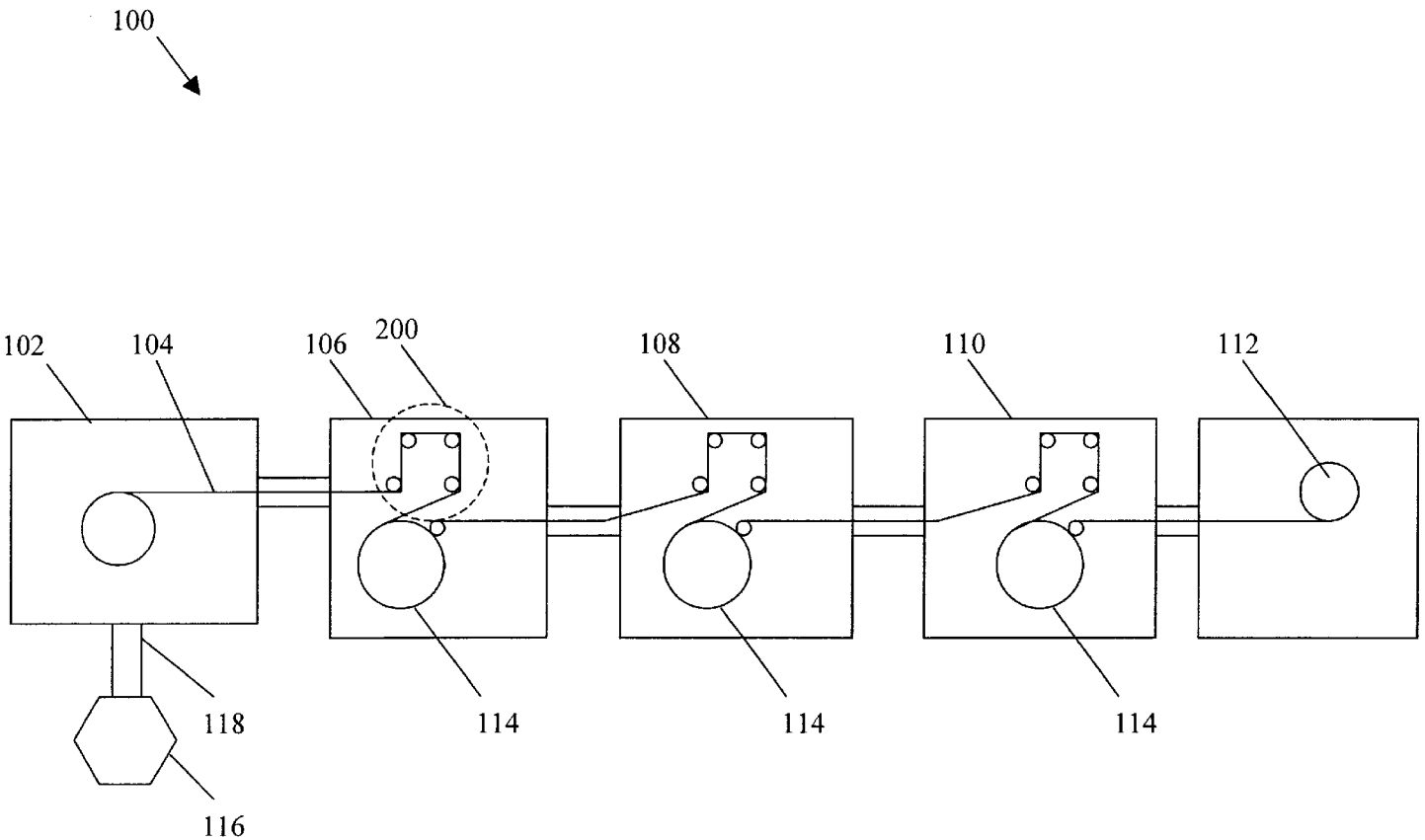
FIG. 1 is schematic representation of web processing equipment in accordance with an embodiment of the invention.
Figure 2:
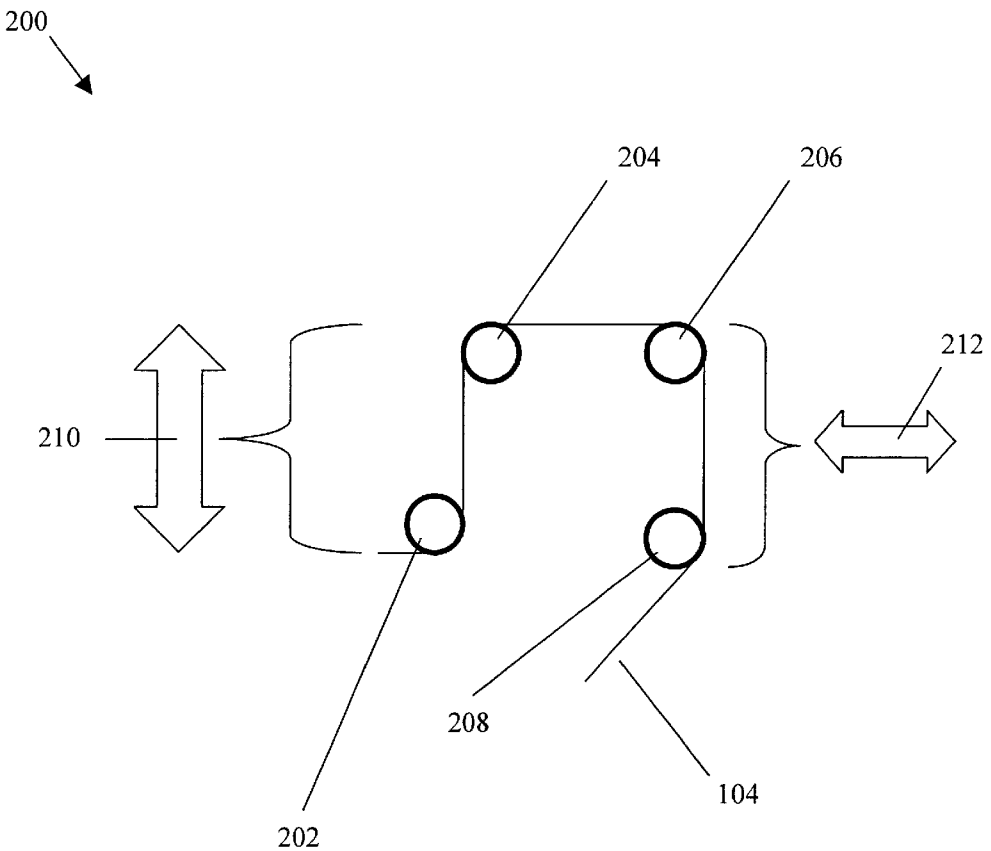
FIG. 2 is schematic representation of a steering section in web processing equipment in accordance with an embodiment of the invention.

As shown in the drawings for the purposes of illustration, the invention is embodied in methods and apparatus that provide control of web floating or tracking in processing equipment. The invention provides a way to reduce or eliminate wrinkles, creases, or both, in a web because of, for example, web misalignment. Existing processing equipment has been unable to provide this comprehensive control over wrinkles, creases, or both. This has resulted in degradation of the finished product and processing equipment inefficiencies.

Figure 3:
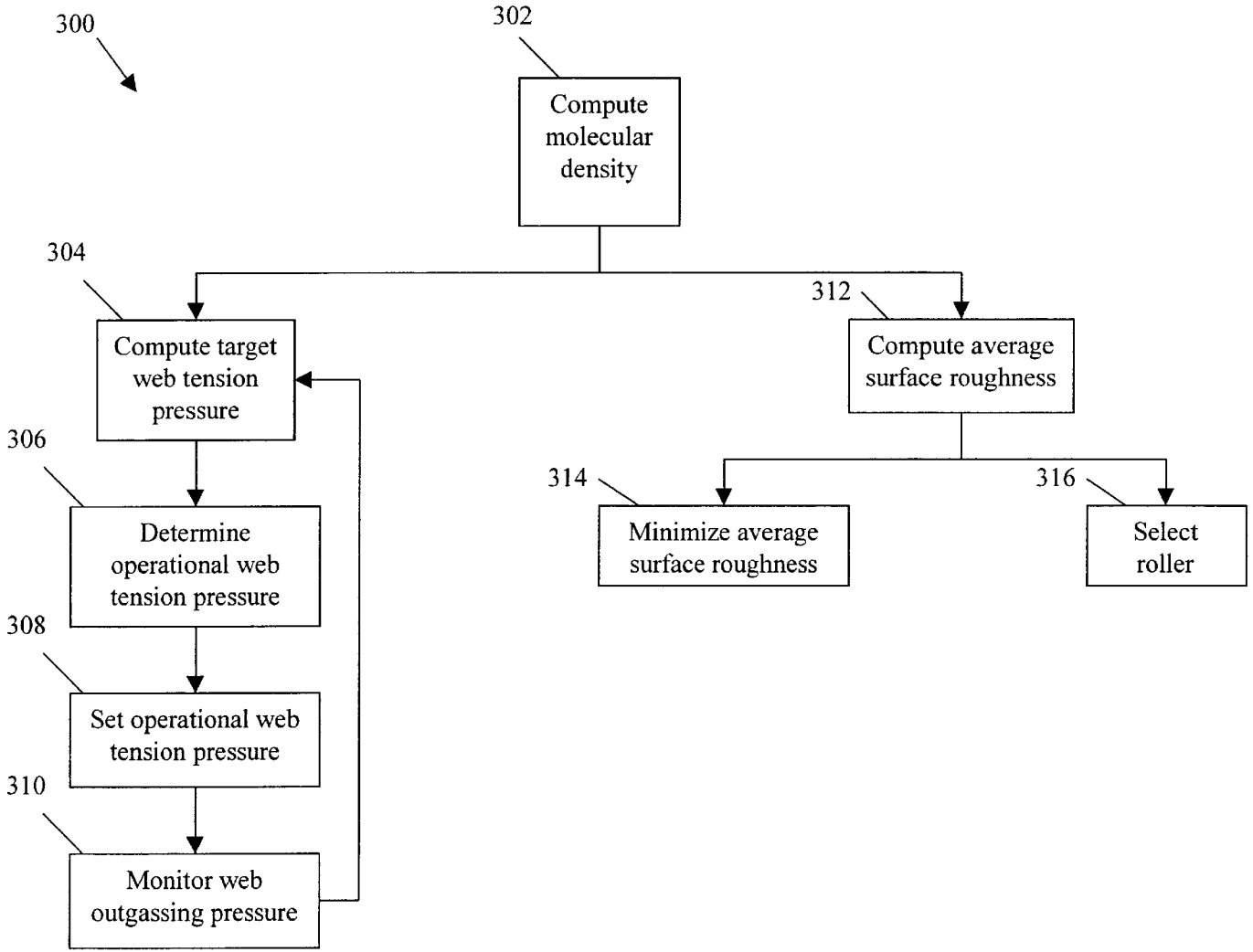
FIG. 3 is a flowchart depicting the steps for prescribing the degree of web floating and tracking in web processing equipment in accordance with an embodiment of the invention.

In brief overview, FIG. 3 shows the steps 300 of one embodiment of the invention. In this embodiment, the web 104, typically when under vacuum in the processing equipment 100, outgasses and thereby creates a web outgassing pressure. (The outgassed material is generally water vapor.) In response to this web outgassing pressure, an equipment operator typically adjusts the tension of the web 104, thereby setting an operational web tension pressure. This operational web tension pressure can be greater than the web outgassing pressure, which would generally result in the web 104 tracking the web transporting roller 114 during operation. Conversely, the operator can adjust the operational web tension pressure so it is less than the web outgassing pressure. In this case, the web 104 typically floats over the web transporting roller 114 during operation and is substantially prevented from making contact with the latter. The operator can also adjust the operational web tension pressure so it is substantially equal to the web outgassing pressure.

During processing, the web outgassing pressure can vary. To maintain the desired relationship between the web outgassing pressure and the operational web tension pressure, the former may be monitored by, for example, the operator. The operator, for example, can reset or adjust the operational web tension pressure as needed to maintain the aforementioned relationship, thereby preserving the desired degree of web tracking or floating.

As an alternative to its measurement, the web outgassing pressure P (atmospheres) may also be determined mathematically by the equation:

$$P=nkT \qquad \text{(Equation 1)}$$

where n is the outgassing molecular density (molecules/$cm^3$), k is Boltzmann's constant ($1.36\times10^{-22}$ atm-$cm^3$/molecule-K), and T is the web temperature (K). A starting point for calculating P is determining n using a series of equations that model the web processing equipment 100.

In the embodiment shown in FIG. 3, the outgassing molecular density is computed (step 302) using water as the dominant outgassing species. As a first step in computing the outgassing molecular density, the throughput Q (torr-liter/s) of the pumping system 116 is determined. Several equations are available to determine Q. These include:

$$Q = 30.48\frac{A^3}{L}P\sqrt{\frac{T}{M}}$$

$$Q = 11.4K'A^2P\sqrt{\frac{T}{M}} \qquad \text{(Clausing Equation)}$$

$$Q = 11.4\left[\frac{1}{1+\frac{3L}{8A}}\right]A^2P\sqrt{\frac{T}{M}} \qquad \text{(DushmanEquation)}$$

In these equations, T is the web temperature (K), P is the ambient pressure (torr), M is the molecular weight (g/molecule), and A and L are the radius (cm) and length (cm), respectively, of the pumping port 118. K' in the Clausing Equation is "Clausing's Factor" and it is determined analytically from the ratio of L/A. For an L/A ratio of five, K'=0.3146.

Once the throughput Q is determined, the molecular flow N (g-mole/s) is typically computed according to the following equation:

$$N = \frac{Q}{RT}$$

where T is again the web temperature (K) and R is the universal gas constant (62.36 torr-L/g-mole-K). A molecular flow rate Γ (molecules/s) of the outgassing species is then computed by multiplying N by Avogadro's Number $N_0$ ($6.023\times10^{23}$ molecules/g-mole):

$$\Gamma = NN_0$$

Dividing Γ by the surface area α ($cm^2$) of the web provides an outgassing molecular flux γ (molecules/$cm^2$-s):

$$\gamma = \frac{\Gamma}{\alpha}$$

Typically, the web 104 is moving over the web transporting roller 114 with a velocity V (cm/s). Only a portion of the length of the web 104 is resident on or over the web transporting roller 114 at any given moment. This portion, denoted as $W_L$ (CM), corresponds to a length of web material arcing over the web transporting roller 114. As it arcs over the web transporting roller 114, this portion is resident for a time t (seconds) given by the following equation:

$$t = \frac{W_L}{V}$$

Accordingly, a molecular surface density ϕ (molecules/$cm^2$) is given by:

$$\phi = \gamma t$$

The molecular surface density ϕ is related to the outgassing molecular density n by the geometry of the interface between the surface of the web 104 and the surface of the web transporting roller 114. These surfaces are typically irregular, resulting in enhanced surface area and slight separation from each other. The degree of outgassing is a function of exposed surface area, and the separation between surfaces defines a volume that can, for example, trap outgassing species.

Figure 4:
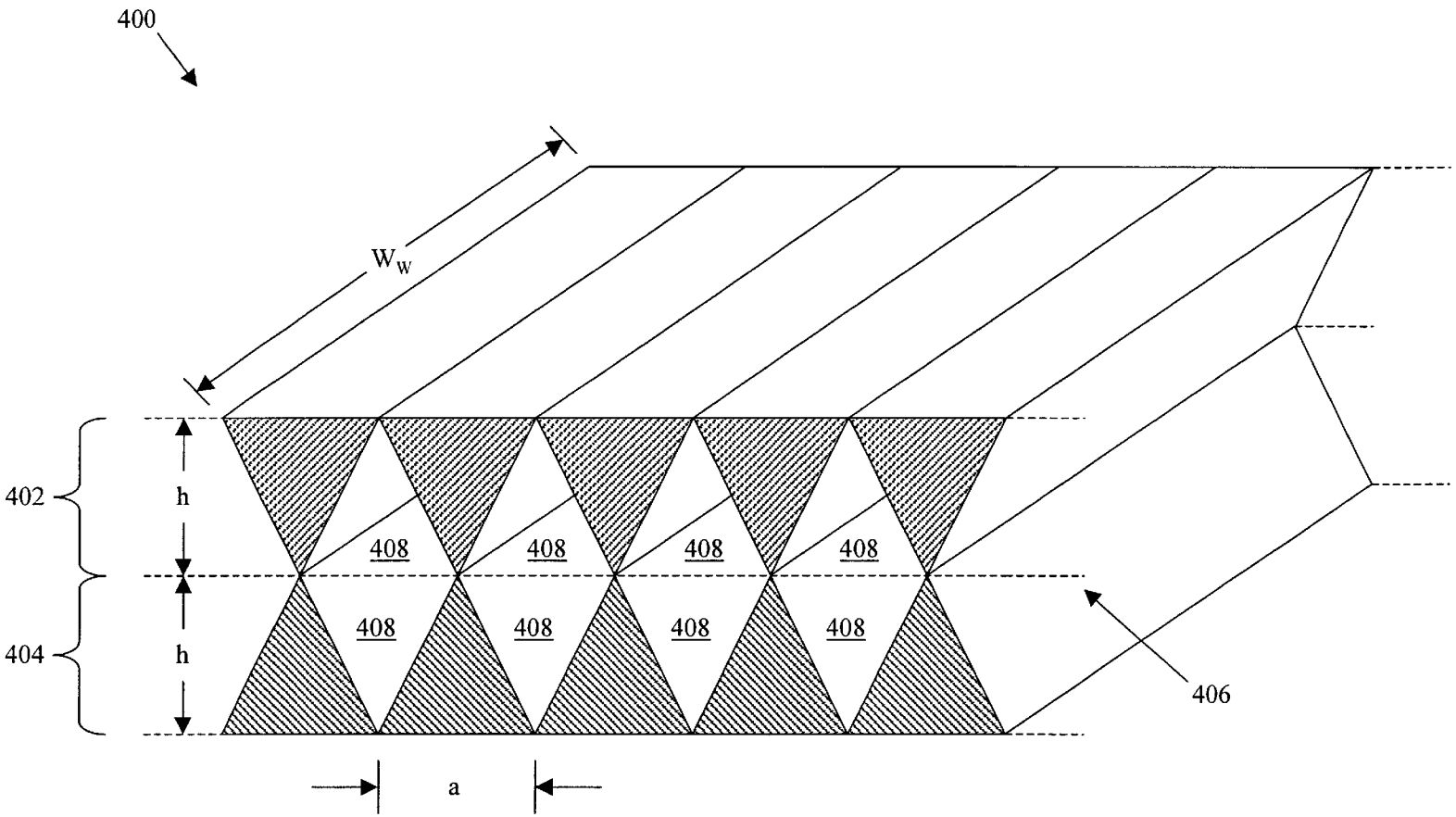
FIG. 4 depicts a surface model in accordance with an embodiment of the invention.

The surfaces of the web 104 and the web transporting roller 114 be modeled in a variety of ways. One simplified model represents each surface as a series of identical prismatic volumes that extend across the web width $W_W$ (cm) of the web 104. FIG. 4 depicts this model 400 where the web surface 402 and transporting roller surface 404 meet at an interface 406. In the model 400, each prismatic volume has, as shown by the shaded regions in FIG. 4, a cross-section that is an equilateral triangle with side length a (cm). The model 400 assumes that all of the equilateral triangles on the web surface 402 are identical, spaced equally, and in peak-to-peak contact with identical equilateral triangles on the transporting roller surface 404. Consequently, cavities 408 are formed between the prismatic volumes. The cavities 408 can trap the aforementioned water vapor.

In practice, the interface 406 typically follows an arcuate path about the web transporting roller 114. FIG. 4 depicts only a portion of the interface 406 and renders it a non-arcuate fashion for simplicity.

Each prismatic volume 408 has a height h (cm) that can be determined from surface topology measurements. The equilateral triangle side length a is related to the height h as follows:

$$a = \frac{2h}{\sqrt{3}}$$

Further, the volume $V_P$ ($cm^3$) of each prismatic volume 408 is given by multiplying the web width $W_W$ by the area of each equilateral triangle:

$$V_P = W_W \frac{a^2\sqrt{3}}{4} = W_W \frac{h^2}{\sqrt{3}}$$

The number of prismatic volumes $n_P$ in the portion $W_L$ of the web 104 is given by:

$$n_P = \frac{W_L}{a}$$

Consequently, the total volume $V_T$ ($cm^3$) of the prismatic volumes within the portion $W_L$ of the web 104 given by the product of $n_P$ and $V_P$:

$$V_T = n_P V_P = W_L W_W \frac{a\sqrt{3}}{4} = \frac{W_L W_H h}{2}$$

Because model 400 assumes that the equilateral triangles on the transporting roller surface 404 are identical to those on the web surface 402, the total volume of all prismatic volumes 408 on both surfaces is equal to $2V_T$. In an alternative model where the equilateral triangles on the transporting roller surface 404 are not identical, the analysis above may still be used with superposition. (Superposition includes applying the analysis to each surface independently and calculating separate $V_T$ values. The resulting $V_T$ values are added and the sum is used in subsequent calculations.) For simplicity, this discussion will use the expression above for $V_T$ without modification.

The model 400 assumes that the total volume $V_T$ is distributed across the entire area of the interface 406. This area is given by the product of $W_L$ and $W_W$. A distribution κ (cm) is defined as the ratio of $V_T$ to the area of the interface 406, as follows:

$$\kappa = \frac{V_T}{W_L W_W} = \frac{a\sqrt{3}}{4} = \frac{h}{2}$$

Dividing the molecular surface density ϕ by κ yields the outgassing molecular density n. Combining the equations above, and recognizing that:

$$\alpha = W_L W_W$$

yields the following:

$$n = \frac{\phi}{\kappa} = \gamma\frac{1}{\kappa}t = \frac{\Gamma}{\alpha}\frac{1}{\kappa}\frac{W_L}{V} = \frac{NN_0}{W_L W_W}\frac{2}{h}\frac{W_L}{V} = \frac{Q}{RT}\frac{N_0}{W_L W_W}\frac{2}{h}\frac{W_L}{V} = \left(\frac{2QN_0}{RT}\right)\frac{1}{hW_W V} \quad \text{(Equation 2)}$$

Consequently, for a given temperature and pumping system throughput, the outgassing molecular density is, according to the model 400, inversely proportional to the product of the height h of the prismatic volume 408, the web width $W_W$, and the web velocity V.

Figure 5:
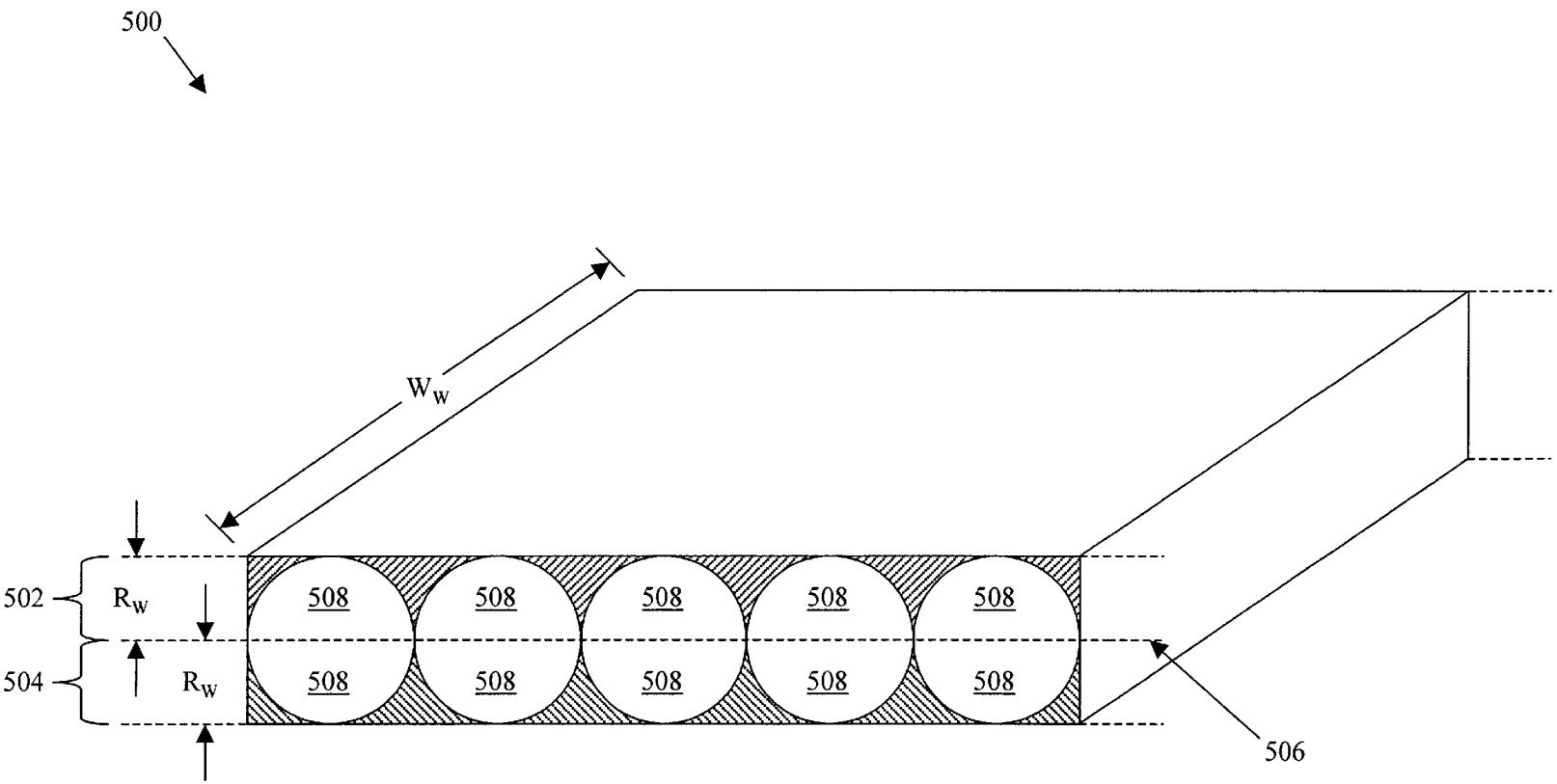
FIG. 5 depicts an alternative surface model in accordance with an embodiment of the invention.

FIG. 5 depicts an alternative model 500 of the surfaces of the web 104 and the web transporting roller 114. The alternative model 500 represents the web surface 502 as having multiple, semi-circular concavities with radius $R_W$ (cm) that extend across the web width $W_W$. The transporting roller surface 504 is modeled as having the identical surface profile. The alternative model 500 assumes that all of the concavities on the web surface 502 are identical, spaced equally, and in peak-to-peak contact with the identical concavities on the transporting roller surface 504 at an interface 506. This defines a series of semi-cylindrical volumes 508, each having radius $R_W$ and axial extent equal to $W_W$. Similar to FIG. 4, the interface 506 typically follows an arcuate path about the web transporting roller 114. FIG. 5 depicts only a portion of the interface 506 and renders it a non-arcuate fashion for simplicity.

The computation of the outgassing molecular density when using the alternative model 500 is similar to that described above with respect to model 400. Nevertheless, one difference is that, instead of prismatic volume, semi-cylindrical volume $V_C$ ($cm^3$) is used:

$$V_C = \frac{\pi R_W^2}{2} W_W$$

Further, the number of semi-cylindrical volumes $n_C$ in the portion $W_L$ of the web 104 is given by:

$$n_C = \frac{W_L}{2R_W}$$

Consequently, the total volume $V_{TC}$ ($cm^3$) of the semi-cylindrical volumes within the portion $W_L$ is, as above, given by the product of $n_C$ and $V_C$:

$$V_{TC} = n_C V_C = \frac{W_L}{2R_W}\frac{\pi R_W^2}{2} W_W = \frac{\pi R_W W_L W_W}{4}$$

Because model 500 assumes that the semi-cylindrical volumes on the transporting roller surface 504 are identical to those on the web surface, the total volume of all semi-cylindrical volumes 508 on both surfaces is equal to $2V_{TC}$. In an alternative model where the semi-cylindrical volumes on the transporting roller surface 504 are not identical, the analysis above may also be used with superposition (described above). For simplicity, this discussion will use the expression above for $V_{TC}$ without modification.

Similar to the case of model 400, the ratio of the total volume $V_{TC}$ to the entire area of the interface 506 defines a distribution $\kappa_C$ (cm) as follows:

$$\kappa_C = \frac{V_{TC}}{W_L W_W} = \frac{\pi R_W}{4}$$

Dividing the molecular surface density $\phi$ by $\kappa_C$ yields the outgassing molecular density n. Combining the equations above yields the following:

$$n = \frac{\phi}{\kappa_C} = \gamma\frac{1}{\kappa_C}t = \frac{\Gamma}{\alpha}\frac{1}{\kappa_C}\frac{W_L}{V} = \frac{NN_0}{W_L W_W}\frac{4}{\pi R_W}\frac{W_L}{V} = \quad \text{(Equation 3)}$$

-continued $$\frac{Q}{RT}\frac{N_0}{W_L W_W}\frac{4}{\pi R_W}\frac{W_L}{V} = \left(\frac{4QN_0}{\pi RT}\right)\frac{1}{R_W W_W V}$$

Consequently, for a given temperature and pumping system throughput, the outgassing molecular density is, according to the alternative model 500, inversely proportional to the product of the radius $R_W$ of the semi-cylindrical volume 508, the web width $W_W$, and the web velocity V.

The radius $R_W$ of the semi-cylindrical volume 508 can be determined by surface topology measurements. Consequently, for both of the models 400, 500 discussed above, results of surface topology measurements are incorporated into the calculation of the outgassing molecular density n. Once surface topology, web width, and velocity values are established, the outgassing molecular density can be calculated in accordance with step 302.

The calculation of the outgassing molecular density can be based on other surface models, including those employing heights or radii that vary across a given surface. A model may also incorporate heights or radii of one surface that differ from those of the other surface. Further, a model may include the effects of non-peak-to-peak contact at the interface between the surfaces.

Web outgassing pressure P (torr) is given by the following equation:

$$P = \frac{2t_W T_W}{d} \quad \text{(Equation 4)}$$

where $t_W$ is the thickness (in) of the web 104, $T_W$ is the target web tension pressure ($lb/in^2$), and d is the diameter (in) of the web transporting roller 114. Setting this equation equal to Equation 1 and solving for $T_W$ yields:

$$T_W = \frac{nkTd}{2t_W} \quad \text{(Equation 5)}$$

Using, for example, one of the surface models described above, a value for the outgassing molecular density n is then substituted into Equation 5 to determine the value of the target web tension pressure (step 304).

At this point, the operational web tension pressure is determined relative to the target web tension pressure (step 306). For example, the operational web tension pressure can be less than the target web tension pressure. In this case, the web 104 floats over the web transporting roller 114, substantially prevented from making contact with it. Alternatively, the operational web tension pressure can be greater than the target web tension pressure. This typically causes the web 104 track the web transporting roller 114. The operational web tension pressure can also be substantially equal to the target web tension pressure. The equipment operator can choose whether to allow web floating or tracking depending on, for example, the composition of the web material, its sensitivity to wrinkling or creasing, the type of material to be deposited onto the web, or the desired quality of the finished (i.e., coated web) product. In any case, the desired operational web tension pressure is then set on the web processing equipment 100 (step 308).

As the web processing equipment 100 operates, the amount of outgassed species can vary. In other words, the outgassing molecular density fluctuates and causes a change in the web outgassing pressure. To preserve the desired degree of floating or tracking of the web 104, an embodiment of the invention monitors the web outgassing pressure in the web processing equipment 100 (step 310) using, for example, one or more pressure gauges. An ion gauge may also be used to measure changes in the vacuum in the web processing equipment 100 that are typically due to variations in web outgassing pressure. The operational web tension pressure is then adjusted (e.g., by an operator) to compensate, thereby retaining the desired relationship between it and the web outgassing pressure.

Alternatively, the monitored web outgassing pressure may be used in Equation 4 to recompute the target web tension pressure. The operational web target pressure is then adjusted to retain the desired relationship between it and the recomputed target web tension pressure. For example, the operational web target pressure can exceed, be substantially equal to, or be less than the target web tension pressure.

For a given web tension pressure, the degree to which the web 104 floats about one or more web transporting rollers 114 depends on the web outgassing pressure which, according to Equation 1, is a function of the outgassing molecular density. As shown by Equations 2 and 3, the outgassing molecular density is inversely proportional to the height or radius of the prismatic volume 408 or cylindrical volume 508, respectively. The height or radius can be interpreted as an "average roughness" of the surface of the web transporting roller 114. In one embodiment, an operator can select a configuration of one or more web transporting rollers 114 based at least in part on this average surface roughness. Based on Equation 2 or 3, the smaller the average surface roughness (i.e., the "smoother" the web transporting rollers 114), the greater the web outgassing molecular density. As Equation 1 shows, this causes greater web outgassing pressure. Accordingly, there is a greater degree of web floating with smoother web transporting rollers 114. If an operator desires this increased degree of web floating, he will minimize the average surface roughness of one or more of the web transporting rollers 114, or the web 104, or both. Conversely, to promote web tracking, the operator will increase the average surface roughness.

One method of selecting select a configuration of one or more web transporting rollers 115 is to compute, using Equation 4, web outgassing pressure based on the web geometry, geometry of at least one web transporting roller 114, and a maximum web tension pressure value. Substituting the resulting value of the outgassing pressure into Equation 1 yields the outgassing molecular density. Then the average surface roughness is computed using Equation 2 or 3 (step 312). The operator can then minimize the average surface roughness of the web transporting roller 114 in relation to the computed average surface roughness (step 314). This can be done by, for example, polishing the surface(s) of one or more of the web transporting rollers 114. It is also possible for the operator to select one or more web transporting rollers 114 that exhibit an actual surface roughness that corresponds to the computed average surface roughness (step 316). In any case, if the web transporting rollers 114, or web 104, or both have an actual surface roughness less than the computed value, increased floating results. If the actual surface roughness is greater than the computed value, increased tracking results.

In a further embodiment, both methods for prescribing the degree to which a web floats about one or more web transporting rollers 114 are used. Specifically, a configuration of one or more web transporting rollers 114 is selected based at least in part on their average surface roughness. Next, an operational web tension pressure is set in relation to the web outgassing pressure as influenced by this average surface roughness. The operational web tension pressure can be greater than, less than, or substantially equal to the web outgassing pressure. Floating typically results when the web tension pressure is less than the web outgassing pressure. Conversely, tracking typically results when the web tension pressure is greater than the web outgassing pressure.

Figure 6:
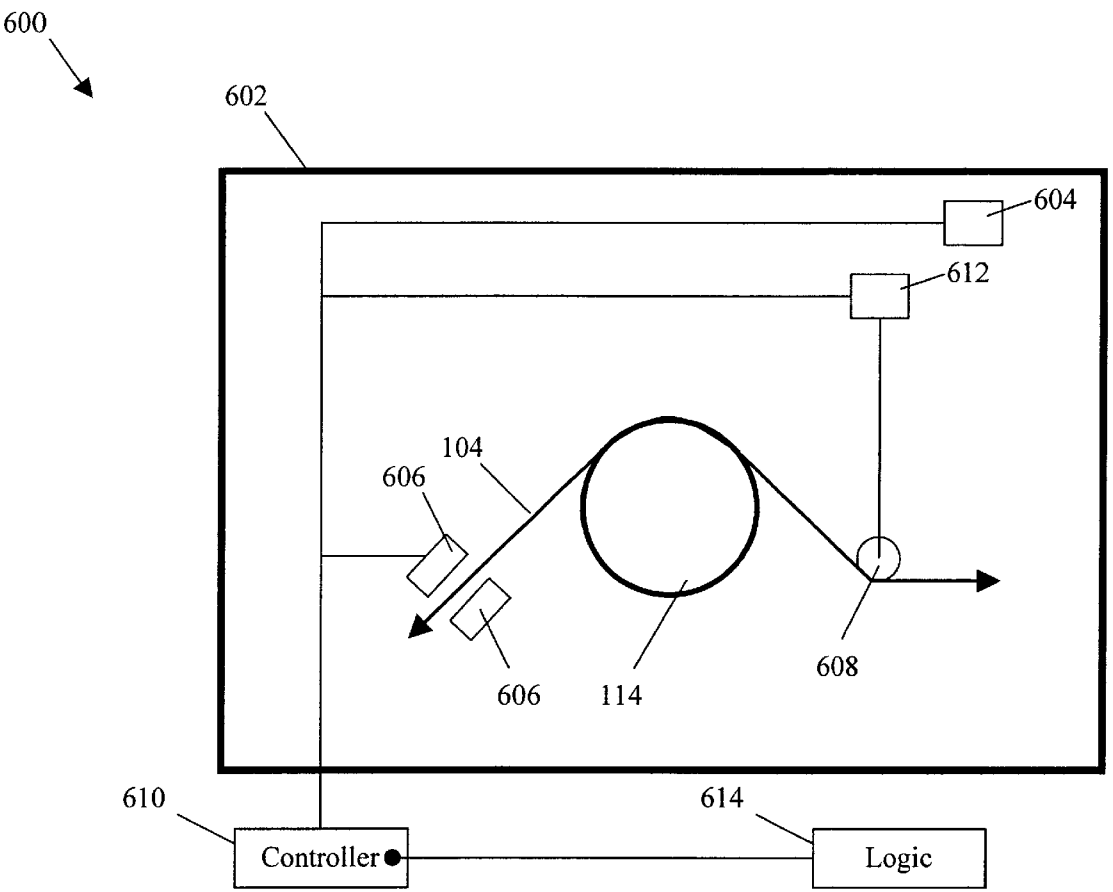
FIG. 6 is a block diagram that depicts apparatus for adjusting operational tension pressure of a web in accordance with an embodiment of the invention.

As shown in FIG. 6, one version of the invention includes apparatus 600 for adjusting the operational tension pressure of the web 104 as it travels over the web transporting roller 114, typically within a chamber 602 that may be kept under vacuum. A pressure sensor 604 monitors the ambient pressure in the chamber 602 about the web transporting roller 114. A tension sensor 606 monitors the tension pressure of the web 104 as it travels across the web transporting roller 114 to a web tensioning roller 608. The web tensioning roller 608 is adjustable to vary the web tension pressure as needed, typically in response to the output of the pressure sensor 604.

A controller 610, such as a computer, is typically in communication with the pressure sensor 604 and the tension sensor 606 to, for example, monitor their outputs. The controller 610 is also in communication with an actuator 612 that adjusts the web tensioning roller 608. This can be accomplished by, for example, a mechanical linkage between the actuator 612 and the web tensioning roller 608. In other words, the controller 610 typically operates to provide closed-loop control of the web processing equipment 100 with feedback.

To perform the necessary tasks, the controller 610 can include logic 614 that computes the outgassing molecular density using the equations described herein or by other, alternative models or methods. Using this computed outgassing molecular density, the logic 614 also computes a target web tension pressure based at least in part on the computed outgassing molecular density. Using the target web tension pressure as an initial value, the logic 614 determines how to adjust the web tensioning roller 608 in response to the web tension pressure actually measured by the tension sensor 606, typically by communicating with the actuator 612 through the controller 610.

Note that because FIG. 6 is a schematic, the items are shown as individual elements. In actual implementations of the invention, however, they may be inseparable components of other electronic devices such as a digital computer. Consequently, the steps discussed above may accomplished by computer-readable program code included on an article of manufacture such as a program storage medium. The program storage medium may include a program of instructions executable by a computer to perform the aforementioned method steps.

From the foregoing, it will be appreciated that the methods and apparatus provided by the invention provide enhanced control over web steering to improve web alignment. Misalignment, wrinkling, and creasing are largely eliminated, thereby avoiding accelerated degradation of the coated web product and increased web processing equipment downtime.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. A method for prescribing the degree to which a web floats about a web transporting roller, the web having an outgassing pressure, the method comprising the steps of:

providing a web;

providing a web transporting roller over which the web travels; and setting an operational web tension pressure in relation to the web outgassing pressure to achieve the prescribed degree of float.

2. The method of claim 1 further comprising the step of placing the web in a vacuum.

3. The method of claim 1 wherein the operational web tension pressure is less than the web outgassing pressure, the web thereby being substantially prevented from making contact with the web transporting roller.

4. The method of claim 1 wherein the operational web tension pressure is substantially equal to the web outgassing pressure.

5. The method of claim 1 wherein the operational web tension pressure is greater than the web outgassing pressure.

6. The method of claim 1 further comprising the steps of:

monitoring the web outgassing pressure as the web travels around the transporting roller; and adjusting the operational web tension pressure in relation to the monitored web outgassing pressure.

7. The method of claim 1 wherein the step of setting an operational web tension pressure further comprises the steps of:

computing a web outgassing molecular density based at least in tart on web geometry and a web velocity;

computing a target web tension pressure based at least in part on the web outgassing molecular density; and setting the operational web tension pressure in relation to the target web tension pressure.

8. The method of claim 7 wherein the operational web tension pressure is less than the target web tension pressure.

9. The method of claim 7 wherein the operational web tension pressure is substantially equal to the target web tension pressure.

10. The method of claim 7 wherein the operational web tension pressure is greater than the target web tension pressure.

11. The method of claim 7 further comprising steps of:

monitoring the web outgassing pressure as the web travels around the transporting roller;

recomputing the target web tension pressure in response to the monitored web outgassing pressure; and adjusting the operational web tension pressure in relation to the recomputed target web tension pressure.

12. The method of claim 11 wherein the operational web tension pressure is less than the recomputed target web tension pressure.

13. The method of claim 11 wherein the operational web tension pressure is substantially equal to the recomputed target web tension pressure.

14. The method of claim 11 wherein the operational web tension pressure is greater than the recomputed target web tension pressure.

15. A method for prescribing the degree to which a web floats about at least one web transporting roller, the web having an outgassing pressure, the method comprising the steps of:

providing a web;

providing at least one web transporting roller over which the web travels, the at least one web transporting roller having an average roughness affecting the degree to which the web floats; and obtaining the prescribed degree of float by selecting a configuration of the at least one web transporting roller based at least in part on the average surface roughness of the at least one web transporting roller.

16. The method of claim 15 further comprising the step of placing the web in a vacuum.

17. The method of claim 15 wherein the step of selecting a configuration of the at least one web transporting roller further comprises the steps of:

computing a preferred web outgassing molecular density based on at least one of web geometry, geometry of the at least one web transporting roller, and a maximum web tension pressure value; and computing the average surface roughness of the at least one web transporting roller based at least in part on the preferred web outgassing molecular density.

18. The method of claim 15 further comprising the step of minimizing the average surface roughness of the at least one web transporting roller.

19. The method of claim 15 further comprising the step of selecting a configuration of the web based at least in part on minimizing an average surface roughness of the web, wherein the average surface roughness of the web affects the degree to which the web floats.

20. A method for prescribing the degree to which a web floats about at least one web transporting roller, the web having an outgassing pressure, the method comprising the steps of:

providing a web;

providing a web transporting roller over which the web travels; and setting an operational web tension pressure in relation to the web outgassing pressure; and selecting a configuration of the at least one web transporting roller based at least in part on an average surface roughness of the at least one web transporting roller to achieve the prescribed degree of float.

* * * * *